United States Patent [19]

Takahashi et al.

[11] Patent Number: 4,572,649

[45] Date of Patent: Feb. 25, 1986

[54] FILM CASSETTE FOR ELECTROPHOTOGRAPHIC CAMERA PROCESSOR-READER

[75] Inventors: Michihiko Takahashi; Eiichi Saito, both of Tokyo; Takeshi Okano, Nishinomiya, all of Japan

[73] Assignee: Fuji Photo Film Co., Ltd., Kanagawa, Japan

[21] Appl. No.: 644,516

[22] Filed: Aug. 27, 1984

[51] Int. Cl.[4] ..... G03G 15/00

[52] U.S. Cl. ..... 355/3 R; 355/5; 355/16; 355/65; 355/133

[58] Field of Search ..... 355/3 R, 5, 16, 64, 355/65, 72, 133; 353/26 A; 242/195; 352/78 R, 72; 354/3; 355/45, 66

[56] References Cited

U.S. PATENT DOCUMENTS 3,917,392 11/1975 Bing ..... 352/78 R X 4,324,484 4/1982 Johnson ..... 355/5

*Primary Examiner*—R. L. Moses

[57] ABSTRACT

Disclosed is a film cassette of a kind which contains an electrophotographic film therein and which is adapted to be loaded in an electrophotographic camera processor-reader. The film cassette includes a cassette casing formed with a reflecting-mirror insertion cavity into which a reflecting mirror is inserted in inclined relation for reflecting light emitted from a projecting light source to direct the light toward a projecting lens. Because of no necessity for incorporation of the elements including the projecting light source and reflecting mirror in the cassette casing, the size and weight of the film cassette itself can be reduced.

6 Claims, 7 Drawing Figures

FILM CASSETTE FOR ELECTROPHOTOGRAPHIC CAMERA PROCESSOR-READER

TECHNICAL FIELD OF THE INVENTION

This invention relates to a film cassette of a kind which contains an electrophotographic film therein and is adapted to be loaded in an electrophotographic camera processor-reader recording picture image data on the electrophotographic film and projecting the picture image data recorded on the electrophotographic film. This film cassette is suitable for use in an electrophotographic camera processor-reader of a kind which includes a combination recording and projecting lens.

BACKGROUND OF THE INVENTION

A microfilm is used as one of means for conveniently storing records of many documents, prints, etc. This microfilm carries these records in a greatly reduced scale, so that the various picture image data recorded on the microfilm can be reenlarged to be projected on a screen or reenlarged to be copied by a copying apparatus when so required.

A conventional microfilm in the form of a silver-halide photosensitive member is defective in that, unlike a magnetic tape, once picture image data are recorded thereon, other required picture image data cannot be additionally recorded thereon or the picture image data already recorded thereon cannot be modified or corrected.

A microfilm in the form of an electrophotosensitive member permitting addition and modification or correction of recorded picture image data has been developed to obviate the defect of the conventional microfilm. This electrophotographic microfilm is formed by laminating a layer of a transparent conductive material and a layer of a transparent photoconductive insulating material on a base of a transparent insulating material. The electrophotographic microfilm has the feature of exhibiting photosensitivity when electrostatically charged. Another feature of the electrophotographic film is that it requires a short length of time and a narrow space for developing. Therefore, after recording a plurality of picture image data of different themes in spaced-apart relation on such an electrophotographic microfilm, relevant picture image data can be additionally recorded adjacent to the recorded picture image data as required.

Recording of picture image data on such an electrophotographic film requires electrophotographic processing means for performing the various steps of processing including electrostatic charging, exposure, developing and fixing of picture image data to be recorded on the electrophotographic microfilm. Also, reading of picture image data recorded on the electrophotographic film requires means for enlarging and projecting the picture image data recorded on the electrophotographic film. For this purpose, an electrophotographic camera processor-reader has been developed which is provided with both the electrophotographic processing means and the enlarging-projecting means above described.

FIG. 1 shows schematically the structure of one form of a prior art electrophotographic camera processor-reader. Referring to FIG. 1, an electrophotographic microfilm 101 in web or belt form is wound at both ends thereof around a pair of winding shafts 102 respectively, and these winding shafts 102 are supported so as to rotate in both the normal and reverse directions relative to a housing 103. An original-supporting glass plate 105, on which an original 104 is placed with its front side facing downward, is disposed on the upper part of the housing 103, and a light source or lamp 106 illuminating the original 104 is disposed beneath the original-supporting glass plate 105.

Along the electrophotographic microfilm 101 extending between the pair of winding shafts 102, a charger 107, a recording lens 108, a developer 109, and a fixing and projecting lamp 110 are disposed in the above order. The charger 107 acts to electrostatically charge the electrophotographic microfilm 101 to render the charged area photosensitive, and the recording lens 108 acts to focus picture image data carried by the original 104 onto the charged area of the electrophotographic microfilm 101. The developer 109 acts to toner-develop an electrostatic latent image of the picture image data formed on the electrophotographic microfilm 101, and the lamp 110 has the function of heat-fixing the toner image of the picture image data formed by the developer 109 on the electrophotographic microfilm 101 and functions also as an illumination light source for projection of an enlarged toner image with transmitted light. For this purpose, a heat shielding filter 111 is movably interposed between the electrophotographic microfilm 101 and the lamp 110 so that it can be brought to a non-heat-shielding position during the step of fixing and to a heat-shielding position during the step of projection. A projecting lens 112 is disposed opposite the illuminating lamp 110 on the other side of the electrophotographic microfilm 101, so that the toner image formed on the electrophotographic microfilm 101 can be projected through three reflecting mirrors 113 onto a translucent screen 114 as an enlarged image.

In such an electrophotographic camera processor-reader, replacement of the electrophotographic microfilm 101 requires the troublesome steps of unloading the electrophotographic microfilm 101 from the position wound around the winding shafts 102 and loading a new electrophotographic microfilm 101 to be wound around the winding shafts 102. In an effort to facilitate handling of an electrophotographic microfilm 101 in such an electrophotographic camera processor-reader, it has been proposed to accommodate the electrophotographic microfilm 101 in a cassette. In such a case too, it is also necessary that, for the purpose of reproduction or projection of picture image data recorded on the electrophotographic microfilm 101, light emitted from the projecting lamp 110 is transmitted through the electrophotographic microfilm 101. That is, the projecting lamp 110 and the projecting lens 112 must be disposed on both sides respectively of the electrophotographic microfilm 101 contained in the cassette. In order that the projecting lamp 110 and the condenser lens 112 can be inserted into the cassette, the cassette itself must be made bulky, resulting in the loss of one of the advantages of the microfilm according to which a quite narrow space is required. On the other hand, U.S. Pat. No. 4,324,484 discloses a cassette containing an electrophotographic microfilm therein. However, due to the fact that a processor assembly for making electrophotographic processing on the electrophotographic microfilm is incorporated in the cassette, the disclosed cassette is defective in that the size of the cassette becomes inevitably large, resulting in degraded portability and storability and also giving rise to an undesirable increase in the manufacturing cost.

SUMMARY OF THE INVENTION

It is an object of the present invention to provide a small-sized and light-weight film cassette which is suitable to be loaded in an electrophotographic camera processor-reader, which permits reproduction or projection of picture image data recorded on an electrophotographic film without the necessity for insertion of a projecting lamp and a condenser lens therein, and which does not include a self-contained processor assembly performing electrophotographic processing on the electrophotographic film.

Another object of the present invention is to provide a film cassette which prevents an undesirable degradation of the photosensitive characteristic of the electrophotographic film due to accidental exposure to external actinic radiation and which permits recording and erasure of retrieval information as desired without regard to picture image data recorded on the electrophotographic film.

Still another object of the present invention is to provide a film cassette in which undesirable sagging of the electrophotographic film does not occur when the film cassette is unloaded from the position loaded in an electrophotographic camera processor-reader.

In accordance with the present invention which attains the above objects, there is provided a film cassette of a kind which contains an electrophotographic film in web form therein and which is adapted to be loaded in an electrophotographic camera processor-reader recording picture image data on the electrophotographic film and projecting the picture image data recorded on the electrophotographic film, the said film cassette comprising a cassette casing containing a pair of rotatable reels around which the electrophotographic film is wound at both ends thereof, an aperture formed in the cassette casing to be positioned opposite an electrophotographic process head mounted on the electrophotographic camera processor-reader including a charging section, an exposure section, a developing section and a fixing section for sequentially performing a series of processing on the electrophotographic film in the above order, and a reflecting-mirror insertion cavity formed in the cassette casing to permit insertion, in inclined relation therein, of a reflecting mirror reflecting light emitted from a projecting light source of the electrophotographic camera processor-reader to direct the light toward a projecting lens of the electrophotographic camera processor-reader. In an embodiment of the present invention, a magnetic tape is connected to at least one end of the electrophotographic film, and a resilient member is interposed between the reels and the cassette casing to resiliently bias the reels toward the inner wall of the cassette casing.

BRIEF DESCRIPTION OF THE DRAWINGS

FIG. 3(*b*) is an enlarged view of the portion B shown in FIG. 3(*a*).

FIGS. 4(*b*) and 4(*c*) are enlarged views of the portions B and C shown in FIG. 4(*a*) respectively.

DETAILED DESCRIPTION OF THE PREFERRED EMBODIMENTS

A preferred embodiment of the film cassette according to the present invention adapted for use in an electrophotographic camera processor-reader will be described in detail with reference to the drawings.

Figure 2:
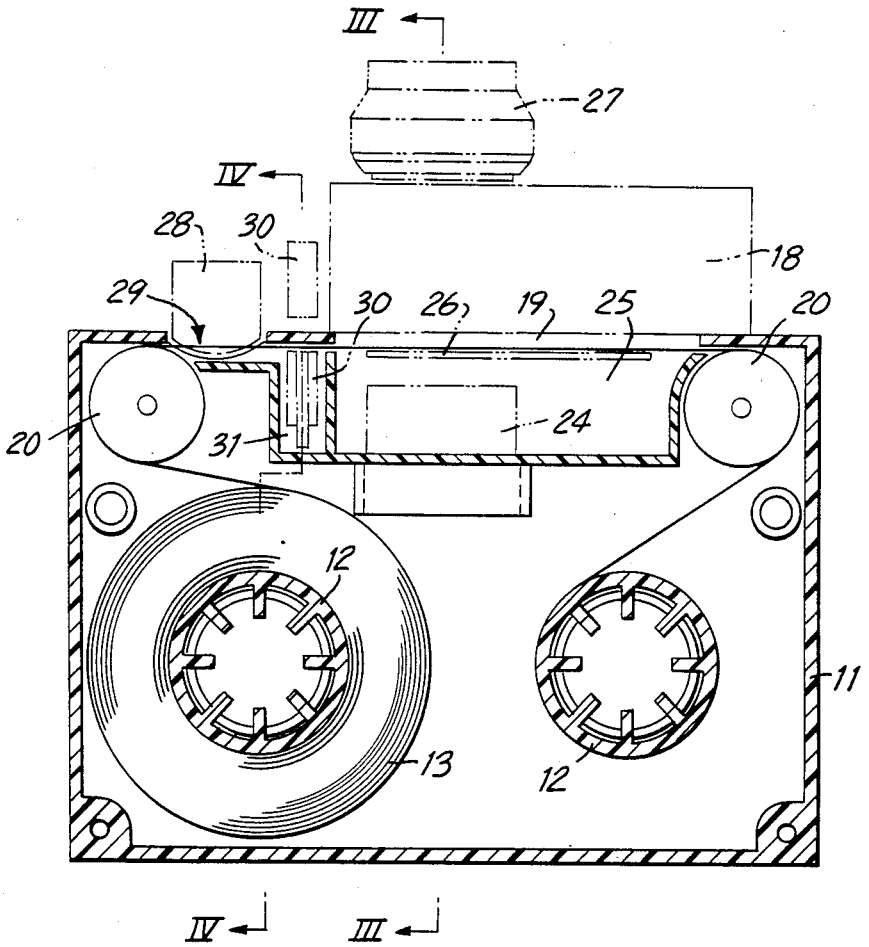
FIG. 2 is a sectional view showing the internal structure of an embodiment of the film cassette according to the present invention adapted for use in an electrophotographic camera processor-reader.
Figure 1:
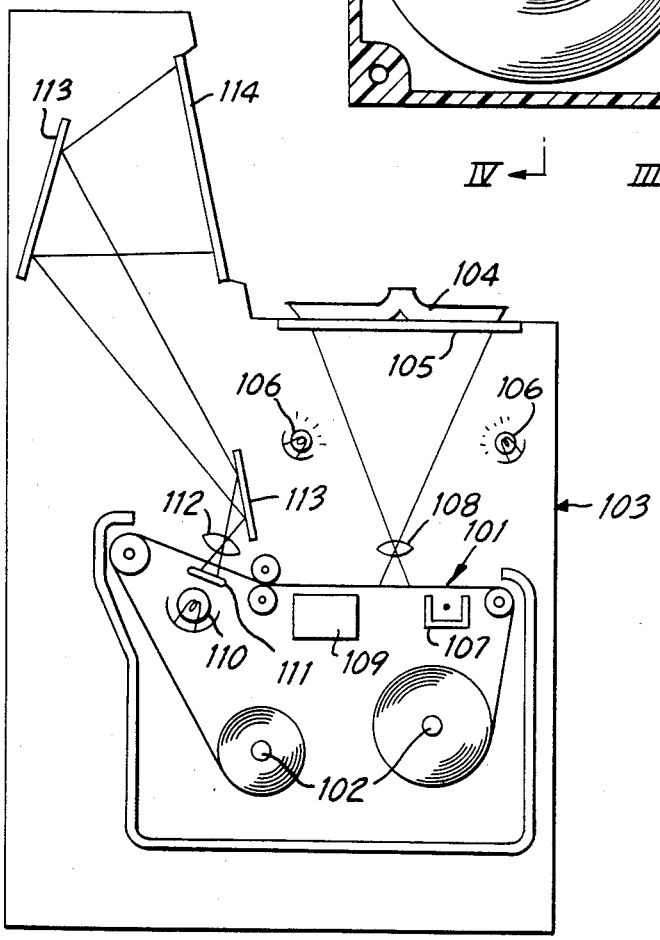
FIG. 1 (PRIOR ART)
FIG. 1 is a diagrammatic view showing schematically the structure of an electrophotographic camera processor-reader used hitherto and commonly known in the art.
Figure 3A:
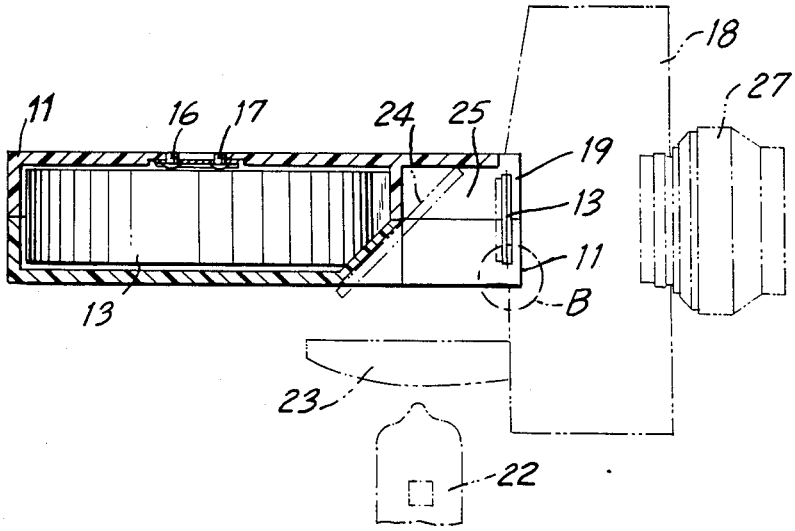
FIG. 3(*a*) is a sectional view taken along the line III—III in FIG. 2.
Figure 3B:
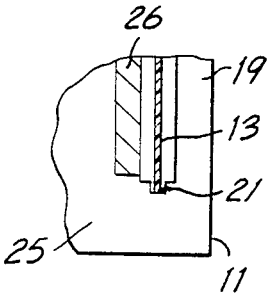
Figure 4A:
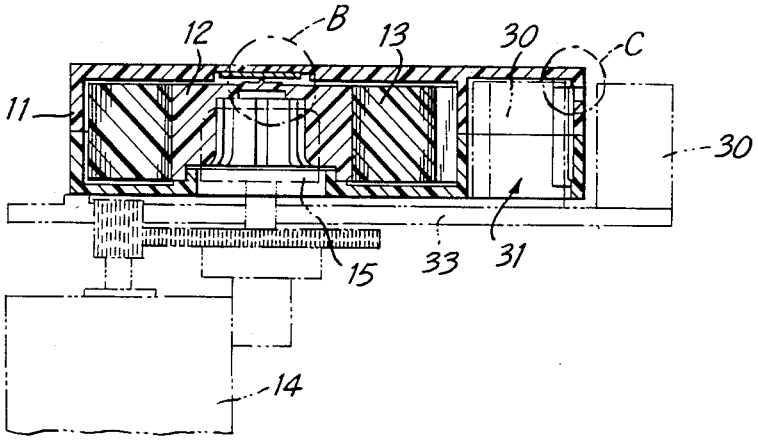
FIG. 4(*a*) is a sectional view taken along the line IV—IV in FIG. 2.
Figure 4B:
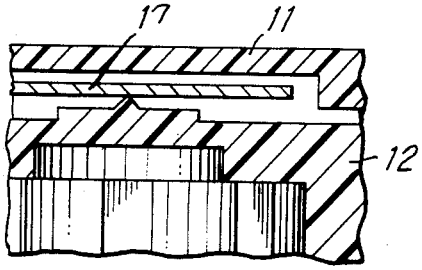
Figure 4C:
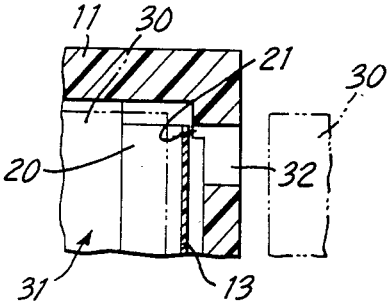

Referring to FIGS. 2, 3(*a*) and 4(*a*), the film cassette embodying the present invention includes a cassette casing 11 which is generally in the form of a rectangular parallelpiped of half-split structure. A pair of reels 12 are rotatably provided within the cassette casing 11, and an electrophotographic film 13 in web form is wound at both ends thereof around the reels 12. A drive shaft 15 that can be rotated in both the normal and reverse directions by a drive motor 14 of an electrophotographic camera processor-reader is removably fitted in the opening of one of the reels 12. As best shown in FIG. 4(*b*), a resilient member or leaf spring 17 resiliently pressing one of the axial ends of the reels 12 is fixed by set screws 16 in the cassette casing 11. This leaf spring 17 acts to bias the reels 12 toward that inner wall of the cassette casing 11 which lies on the side of the drive shaft 15. Accordingly, the friction force produced between the reels 12 and the cassette casing 11 prevents rotation of the reels 12 relative to the cassette casing 11 under inertia, so that an undesirable sag may not occur on the electrophotographic film 13 when the film cassette is unloaded from the electrophotographic camera processor-reader.

The cassette casing 11 is formed with an aperture 19 located opposite an electrophotographic process head 18 mounted on the electrophotographic camera processor-reader when the film cassette is loaded in the latter, and this electrophotographic process head 18 includes a charging and exposure section for electrostatically charging the electrophotographic film 13 and exposing picture image data carried by an original, a developing section for toner-developing an electrostatic latent image formed on the electrophotographic film 13 as a result of charging and exposure, and a fixing section for fixing the toner-developed electrostatic latent image onto the electrophotographic film 13, these sections being arranged in the above order. As the electrophotographic process head 18 preferably employed in the embodiment of the present invention, a head such as, for example, that disclosed in co-pending U.S. patent application Ser. No. 578,522 entitled "Electrophotographic Device" and filed Feb. 9, 1984 can be used.

Although the electrophotographic process head 18 referred to in the embodiment of the present invention includes a combination charging and exposure section, the exposure section may be provided separately from the charging section. Further, in an electrophotographic camera processor-reader employing a developing agent containing a fixing agent therein, its electrophotographic process head includes a combination developing and fixing section. Anyway, it is preferable to suitably select the area of the aperture 19 of the cassette casing 11 so as to meet the size of the electrophotographic process head 18. In order to guide the traveling movement of the electrophotographic film 13 along the aperture 19, a pair of guide rolls 20 with which the electrophotographic film 13 makes running engagement are rotatably mounted in the cassette casing 11. As seen in FIGS. 3(*b*) and 4(*c*), a pair of film guides 21 are formed in the cassette casing 11 to guide the widthwise marginal edges of the electrophotographic film 13, so that the recording zone of the electrophotographic film 13 may not be damaged by direct frictional engagement with the cassette casing 11.

A reflecting-mirror insertion cavity 25, into which a reflecting mirror 24 of the electrophotographic camera processor-reader is inserted, is formed in the cassette casing 11 in integral relation with the aperture 19. Illumination light from a projecting light source or lamp 22 of the electrophotographic camera processor-reader passes through a condenser lens 23 and is then reflected by the reflecting mirror 24 to be directed through the electrophotographic film 13 toward the charging and exposure section of the electrophotographic process head 18 of the electrophotographic camera processor-reader. A pressure plate 26, which is transparent at the portion corresponding to the charging and exposure section of the electrophotographic process head 18, is adapted to be inserted between the reflecting mirror 24 and the electrophotographic film 13 in the reflecting-mirror insertion cavity 25 to press the electrophotographic film 13 against the electrophotographic process head 18. This pressure plate 26 acts to bring the electrophotographic film 13 into intimate touch with the electrophotographic process head 18. In the present invention, this pressure plate 26 is not provided as a part of the film cassette, and, therefore, the weight and size of the film cassette itself can be reduced thereby further reducing the manufacturing cost of the film cassette.

In the electrophotographic camera processor-reader in which the film cassette embodying the present invention is loaded, one lens 27 acts as both a recording lens and a projecting lens. Therefore, the reflecting-mirror insertion cavity 25 is formed in the cassette casing 11 at a position opposite the charging and exposure section of the electrophotographic process head 18, with the electrophotographic film 13 being interposed therebetween. However, in an electrophotographic camera processor-reader in which the projecting lens is provided independently of the recording lens, it is necessary that the reflecting-mirror insertion cavity 25 is formed in the cassette casing 11 opposite the projecting lens, with the electrophotographic film 13 being interposed therebetween. In such a case, the positions of the projecting lamp 22, condenser lens 23 and projecting lens are so selected or modified that the reflecting mirror 24 is disposed opposite the condenser lens 23 and projecting lamp 22 with the electrophotographic film 13 being interposed therebetween. The film cassette embodying the present invention is also applicable to such an electrophotographic camera processor-reader.

In the film cassette embodying the present invention, a magnetic tape (not shown) is connected to at least one end of the electrophotographic film 13, and blip marks are previously printed on the magnetic tape. For the purpose of handling the electrophotographic film 13 having the magnetic tape connected thereto, a magnetic-head insertion cavity 29 and a sensor insertion cavity 31 are formed in the cassette casing 11. Removably inserted into the magnetic-head insertion cabity 29 is a magnetic head 28 for recording and reproducing information relevant to picture image data recorded on the electrophotographic film 13 contained in the film cassette loaded in the electrophotographic camera processor-reader. Inserted into the sensor insertion cavity 31 is one of a pair of transmission type photo sensors 30 disposed opposite to the other, with the electrophotographic film 13 interposed therebetween. The photo sensors 30 are provided for determining the stop position of the electrophotographic film 13 and counting the number of frames. The combination of the magnetic head 28 and the photo sensors 30 permits automatic retreival of desired picture image data. The magnetic-head insertion cavity 29 into which the magnetic head 28 is removably inserted, the sensor insertion cavity 31 into which one of the photo sensors 30 is fixedly inserted, and the reflecting-mirror insertion cavity 25 may be combined together to provide a single cavity, so as to simplify the contour or profile of the cassette casing 11 thereby facilitating the manufacture of the cassette casing 11.

In FIG. 4(*c*), the reference numeral 32 designates a light transmitting aperture bored in the cassette casing 11 for guiding light from one of the transmission type photo sensors 30 toward the other. The magnetic tape connected to at least one end of the electrophotographic film 13 in the film cassette embodying the present invention exhibits a light shielding function thereby preventing fatigue or fading of the electrophotographic film 13 under influence of external actinic light. When the light shielding function only is the factor to be considered, the magnetic tape may be replaced by a light shielding tape such as a paper tape.

The electrophotographic film 13 employed in the film cassette embodying the present invention is in the form of an electrophotosensitive member, as described already. Therefore, it is necessary to establish an electrical connection for grounding the transparent conductive layer of the electrophotographic film 13. This is achieved by any one of known means. For example, at least a portion of the reels 12 may be formed of a metal or like conductive material, a portion of the transparent photoconductive insulating layer providing the surface layer of the electrophotographic film 13 may be stripped off, and a conductive paint may be coated on the exposed portion of the transparent conductive layer, thereby electrically connecting the transparent conductive layer of the electrophotographic film 13 to the reels 12. Then, one of the reels 12 electrically connected to the drive shaft 15 may be electrically connected through the drive shaft 15 to the grounding terminal of the electrophotographic camera processor-reader. In the film cassette according to the present invention, the cassette casing 11 is formed with the magnetic-head insertion cavity 29 together with the sensor insertion cavity 31. However, these cavities 29 and 31 need not necessarily be provided when automatic retrieval of picture image data is not required.

In the recording mode, the film cassette is detachably mounted on a base plate 33 of the electrophotographic camera processor-reader, and the drive shaft 15 is rotated by the drive motor 14 to cause rotation of the reels 12 in the normal or reverse direction, thereby bringing any desired portion of the electrophotographic film 13 to the position opposite the electrophotographic process head 18. By intermittently feeding one frame after another, picture image data are focused by the recording-projecting lens 27 to be recorded on the electrophotographic film 13. In the monitoring mode in which the toner image of the picture image data after or before the step of fixing is monitored, the film portion carrying the toner image is brought to the position opposite the charging and exposure section of the electrophotographic camera processor-reader, and the projecting lamp 22 is energized to project an enlarged equivalent of the toner image formed on the electrophotographic film 13 onto a screen (not shown) by the function of the recording-projecting lens 27.

It will be understood from the foregoing detailed description of the film cassette of the present invention adapted for use in an electrophotographic camera processor-reader that the film cassette can be made small in size and light in weight since the reflecting mirror for directing light from the projecting light source toward the projecting lens is not incorporated in the film cassette, but the cassette casing is formed with a reflecting-mirror insertion cavity into which the refelcting mirror is inserted in an inclined relation. Further, in the present invention, a magnetic tape is connected to at least one end of the electrophotographic film so that desired retrieval information can be recorded on or erased from the magnetic tape as desired. In addition, the magnetic tape having a high light-shielding ability acts to shield the electrophotographic film against external actinic light when the film cassette is unloaded from the electrophotographic camera processor-reader, so that undesirable degradation of the electrophotographic film under influence of external actinic light can be reliably prevented. Also, by virtue of the provision of a resilient member biasing the reels toward the inner wall of the cassette casing, undesirable sagging of the electrophotographic film when unloaded can be reliably prevented.

We claim:

1. A film cassette of a kind which contains an electrophotographic film in web form therein and which is adapted to be loaded in an electrophotographic camera processor-reader recording picture image data on the electrophotographic film and projecting the picture image data recorded on the electrophotographic film, said film cassette comprising a cassette casing containing a pair of rotatable reels around which the electrophotographic film is wound at both ends thereof, an aperture formed in said cassette casing to be positioned opposite an electrophotographic process head mounted on said electrophotographic camera processor-reader including a charging section, an exposure section, a developing section and a fixing section for sequentially performing a series of processing on the electrophotographic film in the above order, and a reflecting-mirror insertion cavity formed in said cassette casing to permit insertion, in inclined relation therein, of a reflecting mirror reflecting light emitted from a projecting light source of said electrophotographic camera processor-reader to direct the light toward a projecting lens of said electrophotographic camera processor-reader.

2. A film cassette as claimed in claim 1, wherein a light shielding tape is connected to at least one end of the electrophotographic film to provide an end portion of said electrophotographic film extending between said reels.

3. A film cassette as claimed in claim 2, wherein said light-shielding tape is a magnetic tape.

4. A film cassette as claimed in claim 3, wherein a magnetic-tape insertion cavity permitting insertion of a magnetic head incorporated in said electrophotographic camera processor-reader is formed in said cassette casing adjacent to said aperture adapted to be positioned opposite said electrophotographic process head.

5. A film cassette as claimed in claim 4, wherein said cavities formed in said cassette casing to receive said reflecting mirror and said magnetic head inserted therein respectively are combined into a single cavity.

6. A film cassette as claimed in claim 1, wherein a resilient member pressing one of the axial ends of said reels thereby resiliently bias the other axial end of said reels toward the inner wall of said cassette casing is interposed between said cassette casing and said reels.

* * * * *